US007087276B2

(12) United States Patent
Sasaki et al.

(10) Patent No.: US 7,087,276 B2
(45) Date of Patent: Aug. 8, 2006

(54) THERMAL TRANSFER RECORDING MEDIUM, THERMAL TRANSFER RECORDING METHOD AND RECORDED ARTICLE

(75) Inventors: Takayuki Sasaki, Mishima (JP); Shigeru Miyajima, Fuji (JP); Yoshiaki Yamada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/081,670

(22) Filed: Mar. 17, 2005

(65) Prior Publication Data

US 2005/0209102 A1 Sep. 22, 2005

(30) Foreign Application Priority Data

Mar. 17, 2004 (JP) ..... 2004-076967

(51) Int. Cl.
*B41M 5/40* (2006.01)
*B41M 5/20* (2006.01)

(52) U.S. Cl. ..... 428/32.85; 503/203; 503/208

(58) Field of Classification Search ..... None
See application file for complete search history.

(56) References Cited

U.S. PATENT DOCUMENTS 4,624,912 A * 11/1986 Zweifel et al. ..... 430/258
5,229,189 A 7/1993 Hiyoshi et al.
5,250,346 A 10/1993 Nagai et al.
5,250,361 A 10/1993 Ide et al.
5,716,477 A 2/1998 Yamaguchi et al.
6,117,562 A 9/2000 Yamaguchi et al.
6,787,203 B1 9/2004 Hiroishi et al.
2003/0133004 A1 7/2003 Miyajima et al.
2004/0063579 A1 4/2004 Noge et al.

FOREIGN PATENT DOCUMENTS

EP 0 864 439 A1 9/1998

OTHER PUBLICATIONS

U.S. Appl. No. 08/291,487, filed Aug. 17, 1995, Yamaguchi et al.

* cited by examiner

*Primary Examiner*—Stephen Stein
*Assistant Examiner*—Timothy M. Speer
(74) *Attorney, Agent, or Firm*—Oblon, Spivak, McClelland, Maier & Neustadt, P.C.

(57) ABSTRACT

A thermal transfer recording medium include a support; and a heat-sensitive transfer layer on the support, and wherein the heat-sensitive transfer layer includes: a resin made from monomer which includes a glycidyl ester of an unsaturated carboxylic acid; and sulfonamide. The present invention also provides a thermal transfer recording method including transferring an image from the thermal transfer recording medium to an image receiving member.

14 Claims, No Drawings

THERMAL TRANSFER RECORDING MEDIUM, THERMAL TRANSFER RECORDING METHOD AND RECORDED ARTICLE

BACKGROUND OF THE INVENTION

Field of the Invention

The present invention relates to a thermal transfer recording medium, a thermal transfer recording method and a recorded article.

In a case where an image is formed on a label for clothing by thermal transfer, the use of cloth such as fabrics without any treatment as an image receiving member causes low print density and invites image missing at the time of thermal transfer recording because cloth have low surface smoothness, that is, a rough surface. As a result, it becomes difficult to obtain an image having satisfactory resolution. Further, since care label of the clothing must withstand washing with the label fixed to clothing, washing durability are required, but there was a problem in that conventional label for clothing had a washing durability lower than satisfactory level.

As techniques for improving washing durability of label for clothing, techniques related to thermal transfer sheet are known in the related art as follows: (1) a method of adding polyamide resin having a melting point of 80 to 150° C. into a thermal transfer layer (Japanese Patent Application Laid-Open (JP-A) No. 05-229262 and JP-A No. 05-042771), (2) a method of laminating a copolymer of ethylene and vinyl acetate, having a low softening point and wax having a melting point of 80 to 130° C. on the polyethylene emulsion having tensile strength of 150 kg/cm$^2$ (JP-A No. 09-080970), and (3) a method of laminating water-insoluble thermoplastic resin on a hydrophilic resin layer (JP-A No. 09-240197).

Moreover, as techniques in which the cloth as a subject is restricted, the following methods are conventionally known: (a) a method of providing thermoplastic adhesive layer on a cloth (JP-A No. 2000-204326), (b) a method of coating a porous layer having fine porous diameter, receiving layer composed of a hydrophilic group-containing polyurethane and image receiving member by a resin having a SP (solubility parameter) of 9.6 cal $^{1/2}$ cm$^{-3/2}$ to 14.2 cal $^{1/2}$ cm$^{-3/2}$' (JP-A No. 7-125464), and (c) a method of forming a receiving layer containing hollow particles and thermoplastic substance (Japanese Patent (JP-B) No. 3181385).

In the former method, the cloth as a subject are not particularly limited; however, it cannot correspond wide range of image receiving member (cloth) from the viewpoint of image clarity and durability. Furthermore, although water washing durability is improved, durability to chlorine dry cleaning is reduced. The latter method, of course, restricts the image receiving member, and thus cannot be versatilely used. In a case where these methods are used in order to improve washing durability, plasticity, elasticity and other properties of the image receiving member are often lost, thus causing problems that handling (feel) which is characteristics of fabrics is decreased and as a label for clothing satisfaction cannot be obtained.

Further, in a case where woven cloth such as polyester, nylon, acetate and cotton is printed by thermal transfer recording method, depending on the coating agent and stiffness of the cloth used as an image receiving member, relative strength between peel force between a transfer layer and a support; and adhesive force between the image receiving member and the transfer layer becomes unstable, thus causing a problem that, after printing, the image receiving member and thermal transfer sheet stick together without peeling off. Regarding this problem, in order to control adhesive force between transferring medium and support, method have been known to improve releasability between transfer layer and support at the time of transfer by providing therebetween an anti-stick layer (JP-B No. 2996623). However, cost increases because one additional coating layer must be provided in order to prevent stick, in addition, heat sensitivity decreases. In order to prevent the decrease in sensitivity, transfer layer must be thinned, thus causing a concern that density of the transferring image decreases.

The technique (JP-B No. 3448696) in which a release layer contains caprolactam oligomer allows a thermal transfer recording medium to be constituted of two layers of release layer and transfer layer. In this technique, since transfer is performed by cohesive failure, the transferring amount of transfer image becomes unstable, which may cause printing failure.

SUMMARY OF THE INVENTION

Accordingly, an object of the present invention is to provide a thermal transfer recording medium which does not cause adhesion to an image receiving member at the time of transfer, and allows clear transferred image with high density on a rough image receiving member, the transferred image having high dry washing durability and water washing durability. Another object of the present invention is to provide a thermal transfer recording method using the said thermal transfer recording medium. Still another object of the present invention is to provide a recorded article in which images are transferred using the said thermal transfer recording method.

According to the present invention, the above-mentioned objects can be achieved. Specifically, following thermal transfer recording medium, thermal transfer recording method and recorded article can be obtained. In order to achieve one of the objects described above, according to one aspect of the present invention, the thermal transfer recording medium includs a support; and a heat-sensitive transfer layer thereon, wherein the heat-sensitive transfer layer includes a resin made from monomer which includes a glycidyl ester of an unsaturated carboxylic acid; and sulfonamide. In another aspect of the present invention, the resin made from monomer which includes a glycidyl ester of an unsaturated carboxylic acid is a reisn made from monomer which includes glycidyl methacrylate. Thus, a thermal transfer recording medium which does not cause adhesion to an image receiving member at the time of transfer and allows clear transferred image with high density on a rough image receiving member can be obtained.

In another aspect of the present invention, the reisn made from monomer which includes glycidyl methacrylate is a copolymer of acrylonitrile, alkyl methacrylate and glycidyl methacrylate. Thus, more excellent transferred image can be obtained.

In another aspect, the sulfonamide is toluenesulfonamide. Thus, a thermal transfer recording medium exhibiting more excellent washing durability can be obtained.

In another aspect, the toluenesulfonamide is o-toluenesulfonamide and/or p-toluenesulfonamide. Thus, a thermal transfer recording medium exhibiting more excellent dry washing durability can be obtained.

In another aspect, the heat-sensitive transfer layer further includes a nitrocellulose resin. Thus, a thermal transfer recording medium exhibiting more excellent dry washing durability can be obtained.

In another aspect, the heat-sensitive transfer layer further includes a colorant.

In another aspect, the thermal transfer recording medium further includes a release layer between the support and the heat-sensitive transfer layer and the release layer includes a polyolefin wax having a solubility parameter of 9.0 cal $^{1/2}$ cm$^{-3/2}$ or less.

In another aspect, the polyolefin wax has a melting point of 100° C. or less.

In another aspect, the polyolefin wax is at least one of a polyethylene wax, a polypropylene wax, an acid modified polyethylene and an acid modified polypropylene.

In another aspect, the thermal transfer recording medium further includes a back surface layer arranged opposite side to the heat-sensitive transfer layer with respect to the support.

In another aspect, the support is a plastic film.

In order to achieve one of the objects described above, according to another aspect of the present invention, in the thermal transfer recording method, an image is transferred from the above-described thermal transfer recording medium to an image receiving member.

In another aspect, the image receiving member includes at least one material selected from the group consisting of polyester, nylon, cotton, and acetate.

In order to achieve one of the objects described above, according to another aspect of the present invention, in the recorded article including an image receiving member on which image is formed, the image is transferred to the image receiving member using the above-described thermal transfer recording method.

According to the present invention, a thermal transfer recording medium which does not cause adhesion to an image receiving member at the time of transfer and allows clear transferred image with high density on a rough image receiving member, the transferred image having high dry washing durability and water washing durability; a thermal transfer recording method using the thermal transfer recording medium; and a recorded article transferred using the thermal transfer recording method can be obtained.

DESCRIPTION OF THE PREFERRED EMBODIMENTS

As an image receiving member for use in the present invention, one or, two or more selected from the group consisting of polyester, nylon, cotton, and acetate, can be used. Examples are woven clothes such as polyester satin, acetate satin, nylon taffeta and plain-woven cotton. Further, clothes in which the surface is slightly coated with a resin may be used. Other than these, the commonly used papers and films such as a non-woven cloth and paper having washing durability can be used to transfer images thereon.

In the thermal transfer recording medium for use in the present invention, a plastic film having a thickness of about 3 μm to 10 μm is generally used as a support. Specific examples of a support material include a polyester, polycarbonate, polyimide, aromatic polyamide, polyether ether keton, and polysulfone. In the present invention, the support material is not limited to these.

As a colorant of the heat-sensitive transfer layer (ink layer), commonly used inorganic pigments and organic pigments, etc. such as known pigments including a carbon black, azo pigments, runblack, aniline black, furnace black, magnetite, aniline blue, ulatramarine blue, malachite green, disazo yellow, pigment red, pigment yellow, and pigment blue, can be used. Of these, the carbon black is particularly preferred.

As a main component of the heat-sensitive transfer layer for use in the present invention, a resin made from monomer comprising a glycidyl ester of an unsaturated carboxylic acid is used. Herein, "the resin made from monomer comprising a glycidyl ester of an unsaturated carboxylic acid" refers to a resin which is synthesized using monomer containing a glycidyl ester of an unsaturated carboxylic acid. The resin may be a homopolymer in which one kind of glycidyl ester of an unsaturated carboxylic acid alone is polymerized, a copolymer in which two or more kind of glycidyl ester of an unsaturated carboxylic acid is polymerized, and a copolymer in which one or more kind of glycidyl ester of an unsaturated carboxylic acid and other one or more kind of monomer is polymerized. And one part or all of these homopolymer and copolymer molecules may be crosslinked or may not. Examples of the glycidyl ester of an unsaturated carboxylic acid are glycidyl acrylate, glycidyl methacrylate, etc. Moreover, the glycidyl ester of an unsaturated carboxylic acid is preferably a resin made from monomer comprising glycidyl methacrylate. Herein, "the resin made from monomer comprising glycidyl methacrylate" refers to a resin which is synthesized using monomer containing glycidyl methacrylate and the resin may be a homopolymer in which glycidyl methacrylate alone is polymerized, and may be a copolymer in which glycidyl methacrylate and other one or more kind of monomer is polymerized, and one portion or all of these homopolymer and copolymer molecules may be crosslinked or may not. Particularly, the resin made from monomer comprising glycidyl methacrylate is preferably a copolymer of acrylonitrile, alkyl methacrylate and glycidyl methacrylate. Here, Examples of the alkyl group of the alkyl methacrylate are lower alkyl groups such as a methyl group, ethyl group, propyl group, isopropyl group, butyl group, isobutyl group, sec-butyl group and tert-butyl group. The use of the copolymer of acrylonitrile, alkyl methacrylate and glycidyl methacrylate allows both of transferability and durability of the image since the transferred image to a woven cloth has an excellent residual properties at the time of water washing and dry washing. When a resin other than these resins made from monomer comprising a glycidyl ester of an unsaturated carboxylic acid is used, washing durability of the transferred image deteriorate, that is, the image may peel off when washing is performed using water, hot water, naphtha, perchloroechylene, industrial gasoline, etc. Moreover, when the solubility parameter of the resin is greatly different from that of image receiving member, forming image itself becomes difficult because of lack of adhesive properties.

It is difficult to transfer a heat-sensitive transfer layer material using heat to thereby form image on a rough surface when the heat-sensitive transfer layer contains only a colorant and resin made from monomer comprising glycidyl ester of an unsaturated carboxylic acid. Thus, in order to obtain clear transferred image on an image receiving member having rough surface, it is required to add sulfonamide as a substance having good hot-melt properties into the heat-sensitive transfer layer in addition to the resin made from monomer comprising a glycidyl ester of an unsaturated carboxylic acid. Of the sulfonamides, toluenesulfonamide is particularly preferred. Example of the toluenesulfonamide compound for use includes o-toluenesulfonamide, p-toluenesulfonamide, N-ethyl-o/p-toluenesulfonamide, N-cyclohexyl-p-toluenesulfonamide, sodium-N-chloro-p-toluenesulfonamide trihydrate, but the toluenesulfonamide compound for use are not limited to these as long as it is toluenesulfonamide. Of these, particularly, use of o-toluenesulfonamide and p-toluenesulfonamide provides satisfactory results. When these compounds are used in heat-sensitive transfer layer together with the copolymer of acrylonitrile, alkyl methacrylate and glycidyl methacrylate, the viscosity of the heat-sensitive transfer layer material decreases upon melting of the heat-sensitive transfer layer material due to heat applied by thermal head from backside of the support, and hence, even in the case of image receiving member having rough surface, heat-sensitive transfer layer material can enter the space between fibers, applied pattern can be reflected without failure, and a clear image can be formed. Moreover, since the heat-sensitive transfer layer which entered the space between fibers improves binding force between fibers, transferred printed image can have improved strength. These phenomena are consider to occur by the following reason. Specifically, the substance having good hot-melt properties for use exhibits sharp hot melt at relatively low temperature, thus causing rapid decrease of the viscosity after hot melt to efficiently enter the space between fibers.

Moreover, in order to further improve the durability against dry cleaning using a chlorinated solvent, a nitrocellulose resin may be added into the heat-sensitive transfer layer as the second resin component. A nitrocellulose resin has excellent properties such as durability to dry-cleaning and heat resistance, but when it is used alone, in some cases, the amount of heat applied by conventional thermal transfer printer is insufficient. Therefore, it is desirable to use a plasticizer such as the above-mentioned one. When the nitrocellulose is added, the amount of addition is preferably 10 to 500 parts by weight to 100 parts by weight of the glycidyl ester of an unsaturated carboxylic acid. Specifically, 10 parts by weight or more is preferred from the viewpoint of dry cleaning durability and 500 parts by weight or less is preferred from the viewpoint of transferability and overall durability.

By the way, at the time of adding toluenesulfonamide, if the toluenesulfonamide is not crystallized, heat-sensitive transfer layer becomes tacky, inviting occurrence of blocking, for example, in the case of rolling up.

To crystallize toluenesulfonamide, known methods may be used and the copolymer of acrylonitrile, alkyl methacrylate and glycidyl methacrylate may be used as a core. Further, formation of back surface layer serving as both anti-heat protective layer and lubricity protective layer, those described later, by a silicone modified resin and amino modified silicone oil can prevent blocking even if the toluenesulfonamide is not crystallized because the back surface layer has mold releasability. The content of the sulfonamide in the heat-sensitive transfer layer is preferably 100 parts by weight or more to 100 parts by weight of the resin made from monomer comprising a glycidyl ester of an unsaturated carboxylic acid from the viewpoint that the applied pattern can be reflected without failure and a clear image can be formed, and that allows the density of the printed image to increase, and preferably 1,000 parts by weight or less from the viewpoint of washing durability.

In addition to the above-mentioned ones, in order to improve sensitivity, prevent drop of heat-sensitive transfer layer from the support and improve dispersion properties, various kinds of substances (e.g. wax and surfactant) may be added into the heat-sensitive transfer layer, but it is desirable to add to such an extend that cleaning durability does not decrease. The above-mentioned heat-sensitive transfer layer forming material is prepared by allowing it to disperse or dissolve in an appropriate solvent, and the heat-sensitive transfer layer may preferably be formed by coating a dissolved coating solution onto the support and drying it.

In the present invention, a release layer may be provided between the support and heat-sensitive transfer layer, and the release layer improves releasability between the heat-sensitive transfer layer and support at the time of printing. When the release layer is heated by a thermal head, it is hot melted to turn into liquid having low viscosity, and thus layers are easily separated in the vicinity of the interface between heated portion and unheated portion. Furthermore, the release layer has an effect of serving as a barrier of the heat-sensitive transfer layer after image formation, thus causing an effect of resistance to smear and physical impact at the time of washing. The hot melt wax of the hot melt wax layer in the release layer for use is preferably a polyolefin wax having a SP (solubility parameter) of 9.0 cal $^{1/2}$ cm$^{-3/2}$ or less. The solubility parameter δ can be conveniently calculated using molecular cohesive energy according to the following equation:

$$\delta=\rho\Sigma F/M$$

where ρ: density of wax (g cm$^{-3}$), M: average molecular weight of polyolefin. The "Σ" in the above equation means that, when the polyolefin of the wax is composed of a plurality of olefin unit such as a modified polyolefin, F of the polyolefin composed of only individual olefin unit is multiplied by abundance ratio of individual olefin unit in the polyolefin molecule of the wax to sum thereof. Specifically, the "F" is a value specific to an atom and functional group in the polymer and SP value of molecule can be obtained by summing F value of individual atom and functional group constituting polyolefin molecule of the wax. This improves layer separating function from the heat-sensitive transfer layer provided thereon and sticking phenomenon that, at the time of thermal transfer, a heat-sensitive transfer component is stuck to the support via the release layer and, after transfer, receiving medium and thermal transfer sheet do not peel off is less likely to occur. Specific example of the polyolefin wax having a SP (solubility parameter) of 9.0 cal $^{1/2}$ cm$^{-3/2}$ or less includes a polyethylene wax, polypropylene wax, acid modified polyethylene and acid modified polypropylene.

In order to prevent drop, improve layer coating properties, etc., a small amount of resin serving as an agent for low viscosity may be added into the release layer, and for this purpose, a copolymer of ethylene and vinyl acetate, copolymer of ethylene and ethyl acrylate, or the like is used.

Moreover, in order to improve adhesive properties between the thermal transfer recording medium and image receiving member by conferring elasticity to release layer, rubbers such as isoprene rubber, butadiene rubber, ethylene propylene rubber, butyl rubber, and nitrile rubber may be added.

When a synthesized wax such as polyolefin is used to prepare the release layer, the compound is made of only one kind of material. Thus, by allowing these waxes to disperse in an organic solvent to prepare a coating solution for the release layer, and drying at the temperature within the range between the temperature higher than the melting start temperature of the used wax by 5° C. and the temperature higher than the melting point of the used wax by 10° C. at the time of drying after coating the solution, part of the used wax (part having low molecular weight) is kept in a dissolved state and part having high molecular weight is kept in a particulate form, allowing layer formation which is uniform and excellent in coating properties. If drying is carried out at the temperature higher than the melting point of the used wax by 10° C. or more, wax is dissolved more, thus causing uneven coating of the solution for a heat-sensitive transfer layer to be coated thereon. It is desirable that the thickness of the release layer is as thin as possible, however, too thin layer cannot exhibit barrier properties. Thus, in general, coating amount to form the layer is 0.1 g/m$^2$ to 3.0 g/m$^2$, preferably 0.2 g/m$^2$ to 2.0 g/m$^2$.

Moreover, if the melting point of the polyolefin wax exceeds 100° C., too much heat energy is applied at the time of transferring, thus causing decrease of the sensitivity as a thermal transfer recording medium. Therefore, the melting point is preferably 100° C. or less. Specific example of the polyolefin wax includes a polyethylene wax, polypropylene wax, acid modified polyethylene, acid modified polypropylene, etc., each treated so as to have low-molecular weight.

Furthermore, in order to further confer barrier properties, an intermediate layer may be provided between the release layer and heat-sensitive transfer layer, and in this intermediate layer, known resins may be mainly used. When the intermediate layer is provided, the whole thickness of the layer to be transferred to the image receiving member increases, therefore, it is desirable to adopt the intermediate layer to such an extent that efficient application of heat to the heat-sensitive transfer layer by a thermal head is not inhibited.

Since, at the time of performing thermal transfer recording, heat is applied by a thermal head or the like from back surface of the support (opposite surface to the surface where the heat-sensitive transfer layer is formed) according to the image, the thermal transfer recording medium for use in the present invention may comprise a layer which has a resistance to the high heat (anti-heat protective layer) or a layer which has a resistance to friction with the thermal head (lubricity protective layer) as a back surface layer, if required.

Further, part of back surface is heat fused to the thermal head, which hurts transfer image and cause a phenomenon that makes it difficult for the thermal transfer recording medium to be conveyed (This phenomenon is called sticking). Thus, the thermal transfer recording medium may comprise a layer for preventing this phenomenon (anti-stick layer). These back surface layer are each thin layers which is formed of heat-resistant polymer and one layer may be served as two or more kinds of layers.

EXAMPLES

Example 1

First, a coating solution for forming a release layer having the following composition was coated on a polyester film (support) having a thickness of 4.5 μm and dried at 40° C. for 10 seconds to thereby provide a release layer having a dried coated amount of 0.8 g/m$^2$, and a coating solution for forming a heat-sensitive transfer layer having the following composition was coated thereon and dried at 70° C. for 10 seconds to thereby provide a release layer having a dried coated amount of about 1.5 g/m$^2$. Next, a 1% toluene solution of silicone rubber was coated on the surface of the support opposite to the side to which the heat-sensitive transfer layer is provided so as to have dried coated amount of 0.02 g/m$^2$ and dried at 50° C. for 10 seconds to thereby provide a back surface layer, and thus the thermal transfer recording medium of the present invention was manufactured.

| (Composition of the coating solution for forming a release layer) | |
|---|---|
| Polyethylene wax (melting point: 105° C., solubility parameter: 7.9) | 9 parts |
| Resin of a copolymer of ethylene and vinyl acetate | 1 part |
| Toluene | 90 parts |
| (Composition of the coating solution for forming a heat-sensitive transfer layer) | |
| Carbon black | 5 parts |
| Resin of poly glycidyl methacrylate | 5 parts |
| N-ethyl-o/p-toluenesulfonamide | 6 parts |
| Methyl ethyl ketone (MEK) | 84 parts |

Example 2

A release layer and back surface layer were formed in the same way as in Example 1, a coating solution for forming a heat-sensitive transfer layer having the following composition was coated on the release layer and dried at 70° C. for 10 seconds to thereby provide a heat-sensitive transfer layer having a dried coated amount of about 1.5 g/m$^2$.

| (Composition of the coating solution for forming a heat-sensitive transfer layer) | |
|---|---|
| Carbon black | 5 parts |
| Resin of a copolymer of acrylonitrile, methyl methacrylate and glycidyl methacrylate | 5 parts |
| N-ethyl-o/p-toluenesulfonamide | 6 parts |
| Methyl ethyl ketone (MEK) | 84 parts |

Example 3

A release layer and back surface layer were formed in the same way as in Example 1, a coating solution for forming a heat-sensitive transfer layer having the following composition was coated on the release layer and dried at 70° C. for 10 seconds to thereby provide a heat-sensitive transfer layer having a dried coated amount of about 1.5 g/m$^2$.

| (Composition of the coating solution for forming a heat-sensitive transfer layer) | |
|---|---|
| Carbon black | 5 parts |
| Resin of a copolymer of acrylonitrile, methyl methacrylate and glycidyl methacrylate | 5 parts |
| o-Toluenesulfonamide | 5 parts |
| p-Toluenesulfonamide | 1 parts |
| Methyl ethyl ketone (MEK) | 84 parts |

Example 4

A release layer and back surface layer were formed in the same way as in Example 1, a coating solution for forming a heat-sensitive transfer layer having the following composition was coated on the release layer and dried at 70° C. for 10 seconds to thereby provide a heat-sensitive transfer layer having a dried coated amount of about 1.5 g/m$^2$.

| (Composition of the coating solution for forming a heat-sensitive transfer layer) | |
|---|---|
| Carbon black | 5 parts |
| Resin of a copolymer of acrylonitrile, methyl methacrylate and glycidyl methacrylate | 3 parts |
| Nitrocellulose resin | 2 parts |
| o-Toluenesulfonamide | 5 parts |
| p-Toluenesulfonamide | 1 parts |
| Methyl ethyl ketone (MEK) | 84 parts |

A back surface layer was formed in the same way as in Example 1, a coating solution for forming a release layer having the following composition was coated on the side of the support where the back surface layer was not formed and dreied at 40° C. for 10 seconds to thereby provide a release layer having a dried coated amount of 0.8 g/m$^2$, and a coating solution for forming a heat-sensitive transfer layer having the following composition was coated thereon and dreied at 70° C. for 10 seconds to thereby provide a release layer having a dried coated amount of about 1.5 g/m$^2$.

| (Composition of the coating solution for forming a release layer) | |
|---|---|
| Polyethylene wax (melting point: 90° C., solubility parameter: 7.9) | 9 parts |
| Resin of a copolymer of ethylene and vinyl acetate | 1 part |
| Toluene | 90 parts |
| (Composition of the coating solution for forming a heat-sensitive transfer layer) | |
| Carbon black | 5 parts |
| Resin of a copolymer of acrylonitrile, methyl methacrylate and glycidyl methacrylate | 3 parts |
| Nitrocellulose resin | 2 parts |
| o-Toluenesulfonamide | 5 parts |
| p-Toluenesulfonamide | 1 parts |
| Methyl ethyl ketone (MEK) | 84 parts |

Comparative Example 1

On a support (polyester film), a release layer was formed in the same way as in Example 1, a coating solution for forming a heat-sensitive transfer layer having the following composition was coated thereon and dried at 70° C. for 10 seconds to thereby provide a heat-sensitive transfer layer having a dried coated amount of about 1.5 g/m$^2$. The back surface layer was provided in the same way as in Example 1. Thus, the thermal transfer recording medium of the present invention was manufactured.

| (Composition of the coating solution for forming a heat-sensitive transfer layer) | |
|---|---|
| Carbon black | 4 parts |
| Resin of a copolymer of acrylonitrile, methyl methacrylate and glycidyl methacrylate | 12 parts |
| Methyl ethyl ketone (MEK) | 84 parts |

Comparative Example 2

On a support (polyester film), a release layer was formed in the same way as in Example 1, a coating solution for forming a heat-sensitive transfer layer having the following composition was coated on the release layer and dried at 70° C. for 10 seconds to thereby provide a heat-sensitive transfer layer having a dried coated amount of about 1.5 g/m$^2$. The back surface layer was provided in the same way as in Example 1. Thus, the thermal transfer recording medium of the present invention was manufactured.

| (Composition of the coating solution for forming a heat-sensitive transfer layer) | |
|---|---|
| Carbon black | 5 parts |
| Resin of a copolymer of acrylonitrile and methyl methacrylate | 5 parts |
| o-Toluenesulfonamide | 6 parts |
| Methyl ethyl ketone (MEK) | 84 parts |

Comparative Example 3

On a support (polyester film), a release layer having the following composition was formed, and a coating solution for forming a heat-sensitive transfer layer having the following composition was coated thereon and dried at 70° C. for 10 seconds to thereby provide a heat-sensitive transfer layer having a dried coated amount of about 1.5 g/m$^2$. The back surface layer was provided in the same way as in Example 1. Thus, the thermal transfer recording medium of the present invention was manufactured.

| (Composition of the coating solution for forming a release layer) | |
|---|---|
| Carnauba wax (melting point: 83° C., solubility parameter: 10.5) | 9 parts |
| Resin of a copolymer of ethylene and vinyl acetate | 1 part |
| Toluene | 90 parts |
| (Composition of the coating solution for forming a heat-sensitive transfer layer) | |
| Carbon black | 5 parts |
| Nitrocellulose resin | 5 parts |
| o-Toluenesulfonamide | 5 parts |
| p-Toluenesulfonamide | 1 parts |
| Methyl ethyl ketone (MEK) | 84 parts |

The thermal transfer recording mediums of Examples 1 to 5 and Comparative Examples 1 to 3 manufactured as described above, was evaluated by printing 7- to 10-point character and a horizontal ruled line having a width of 0.22 mm on a polyester satin cloth (T-3030 manufactured by Takaoka) using thermal transfer printer (line-type thin film thermal head, I-4308 manufactured by DATAMAX, print speed: 101. 6 mm/sec, dot density: 12 dots/mm). Readability of the character transferred by the printing test and transferability at solid printed area were evaluated. Also, for thermal transfer recording image, the following washing durability evaluation test was carried out. The results are shown in Table 1.

TABLE 1

| | Character | Density of solid | Adhesiveness | | Washing durability (density after washing) | |
|---|---|---|---|---|---|---|
| | readability | image (Macbeth) | 7-point character | Horizontal ruled line | Water washing | Dry cleaning |
| Example 1 | A | 1.20 | B | B | 0.85 | 0.85 |
| Example 2 | A | 1.70 | B | B | 0.96 | 0.95 |
| Example 3 | A | 1.29 | B | B | 0.97 | 0.95 |
| Example 4 | A | 1.22 | B | B | 0.98 | 1.10 |
| Example 5 | A | 1.24 | B | B | 0.98 | 1.11 |
| Comp. Ex. 1 | D | 0.15 | B | B | 0.15 | 0.15 |
| Comp. Ex. 2 | B | 0.94 | B | B | 0.47 | 0.14 |
| Comp. Ex. 3 | C | 1.10 | D | D | 0.53 | 0.98 |

Table 1 shows that, in Example 1, satisfactory results are obtained in transferability, anti-adhesiveness and washing durability, in Example 2, washing durability is superior, in Example 3, transferability is superior, in Examples 4 and 5, dry washing durability is superior.

(Evaluation test method)

Adhesiveness: for 7-point character and Horizontal ruled line, adhesiveness was evaluated as follows: after printing, if receiving medium and thermal transfer sheet was ejected with those completely peeled off, it was evaluated as "B", if receiving medium and thermal transfer sheet was ejected with those slightly stuck, it was evaluated as "C", and if the surface layer of the receiving medium was stuck with thermal transfer and both were not peeled off, it was evaluated as "D".

Readability: readability was evaluated with eyes was evaluated as follows: if 7-point character is printed clear and can be read, it was evaluated as "A", if 8-point character is printed clear and can be read, it was evaluated as "B", if 9-point character is printed clear and can be read, it was evaluated as "C", and if the character cannot be read, it was evaluated as "D".

Washing durability: the method established in JIS L 0844 A-5 was carried out 5 times.

Dry washing durability: the method established in JIS L 0860 was carried out 5 times. For cleaning solvent, perchloroechylene was used and it was carried out at the temperature of 40° C. In the evaluation of the results of the washing durability test and dry washing durability, density was measured using Macbeth reflective densitometer and density value before and after washing is described.

What is claimed is:

1. A thermal transfer recording medium, comprising:

a support; and a heat-sensitive transfer layer on the support, and wherein the heat-sensitive transfer layer comprises:

a resin made from monomer which comprises a glycidyl ester of an unsaturated carboxylic acid; and sulfonamide.

2. A thermal transfer recording medium according to claim 1, wherein the resin made from monomer which comprises a glycidyl ester of an unsaturated carboxylic acid is a resin made from monomer which comprises glycidyl methacrylate.

3. A thermal transfer recording medium according to claim 2, wherein the resin made from monomer which comprises glycidyl methacrylate is a copolymer of acrylonitrile, alkyl methacrylate and glycidyl methacrylate.

4. A thermal transfer recording medium according to claim 1, wherein the sulfonamide is toluenesulfonamide.

5. A thermal transfer recording medium according to claim 4, wherein the toluenesulfonamide is at least one of o-toluenesulfonamide and p-toluenesulfonamide.

6. A thermal transfer recording medium according to claim 1, wherein the heat-sensitive transfer layer further comprises a nitrocellulose resin.

7. A thermal transfer recording medium according to claim 1, wherein the heat-sensitive transfer layer further comprises a colorant.

8. A thermal transfer recording medium according to claim 1, further comprising a release layer between the support and the heat-sensitive transfer layer, wherein the release layer comprises a polyolefin wax having a solubility parameter of 9.0 cal $^{1/2}$ cm$^{-3/2}$ or less.

9. A thermal transfer recording medium according to claim 8, the polyolefin wax has a melting point of 100° C. or less.

10. A thermal transfer recording medium according to claim 8, the polyolefin wax is at least one of a polyethylene wax, a polypropylene wax, an acid modified polyethylene and an acid modified polypropylene.

11. A thermal transfer recording medium according to claim 1, further comprising a back surface layer arranged opposite side to the heat-sensitive transfer layer with respect to the support.

12. A thermal transfer recording medium according to claim 1, wherein the support is a plastic film.

13. A thermal transfer recording method, comprising:

transferring an image by thermal transfer from a thermal transfer recording medium to an image receiving member, wherein the thermal transfer recording medium comprises:

a support; and a heat-sensitive transfer layer on the support, and wherein the heat-sensitive transfer layer comprises:

a resin made from monomer which comprises a glycidyl ester of an unsaturated carboxylic acid; and sulfonamide.

14. A thermal transfer recording method according to claim 13, wherein the image receiving member comprises at least one material selected from the group consisting of polyester, nylon, cotton, and acetate.

* * * * *